US009347457B2

(12) United States Patent
Ahrens et al.

(10) Patent No.: US 9,347,457 B2
(45) Date of Patent: May 24, 2016

(54) LIQUID PUMP WITH AXIAL THRUST WASHER

(71) Applicant: Robert Bosch GmbH, Stuttgart (DE)

(72) Inventors: Dietmar Ahrens, Lahr (DE); Christoph Heier, Iffezheim (DE); Claudius Muschelknautz, Buehl (DE)

(73) Assignee: Robert Bosch GmbH, Stuttgart (DE)

( * ) Notice: Subject to any disclaimer, the term of this patent is extended or adjusted under 35 U.S.C. 154(b) by 739 days.

(21) Appl. No.: 13/677,524

(22) Filed: Nov. 15, 2012

(65) Prior Publication Data

US 2013/0121808 A1 May 16, 2013

(30) Foreign Application Priority Data

Nov. 16, 2011 (DE) ..... 10 2011 086 460

(51) Int. Cl.
*F04D 29/041* (2006.01)
*F04D 29/046* (2006.01)
*F04D 29/047* (2006.01)

(52) U.S. Cl.
CPC ..... *F04D 29/046* (2013.01); *F04D 29/0413* (2013.01); *F04D 29/0465* (2013.01); *F04D 29/0473* (2013.01)

(58) Field of Classification Search
CPC ... F04D 29/04; F04D 29/046; F04D 29/0462; F04D 29/0465; F04D 29/047; F04D 29/0473; F04D 29/0476; F04D 29/05; F04D 29/051; F04D 29/0513; F04D 29/056; F04D 29/0563; F04D 29/0566; F04D 29/057; F04D 29/041; F04D 29/0413
See application file for complete search history.

(56) References Cited

U.S. PATENT DOCUMENTS

| | | | | |
|---|---|---|---|---|
| 3,838,755 | A * | 10/1974 | Cochran et al. | 188/166 |
| 4,722,661 | A * | 2/1988 | Mizuno | 415/131 |
| 5,090,944 | A * | 2/1992 | Kyo et al. | 464/29 |
| 5,887,465 | A * | 3/1999 | Shen | 70/224 |
| 6,106,224 | A * | 8/2000 | Sheth et al. | 415/104 |
| 6,280,156 | B1 * | 8/2001 | Wirz et al. | 417/420 |
| 7,040,453 | B2 * | 5/2006 | Borcherding | 184/7.1 |
| 7,131,823 | B2 * | 11/2006 | Kalavsky | 417/356 |
| 2006/0245955 | A1 * | 11/2006 | Horiuchi et al. | 417/420 |
| 2013/0121808 | A1 * | 5/2013 | Ahrens et al. | 415/104 |

* cited by examiner

*Primary Examiner* — Igor Kershteyn
*Assistant Examiner* — Christopher R Legendre
(74) *Attorney, Agent, or Firm* — Michael Best & Friedrich LLP

(57) ABSTRACT

A liquid pump, in particular a water pump, comprises a pump housing, which has a thrust bearing seat, a bearing bolt and a bearing mounted on the bearing bolt. In this case, a thrust washer is arranged between the thrust bearing seat of the pump housing and the bearing. Furthermore, a flexible washer is arranged between the thrust bearing seat and the thrust washer.

10 Claims, 7 Drawing Sheets

LIQUID PUMP WITH AXIAL THRUST WASHER

BACKGROUND OF THE INVENTION

It is known to form liquid pumps, for example water pumps, with rotatable rotors. It is likewise known to arrange in the region of a thrust bearing seat of a housing of such a pump a thrust washer, which serves as an opposing counterpart for a movable bearing bush. In the prior art, such thrust washers are produced from high-grade steel. However, it has been found that thrust washers made of high-grade steel are subject to wear that restricts the service life of conventional pumps.

It is known to use liquid pumps in motor vehicles for charge-air cooling, battery cooling, control equipment cooling and further cooling circuits.

SUMMARY OF THE INVENTION

The object of the present invention is to provide a liquid pump that has an increased service life.

A liquid pump according to the invention, in particular a water pump, comprises a pump housing, which has a thrust bearing seat, a bearing bolt and a bearing mounted on the bearing bolt. In this case, a thrust washer is arranged between the thrust bearing seat of the pump housing and the bearing. Furthermore, a flexible washer is arranged between the thrust bearing seat and the thrust washer. Advantageously, tolerances and angularity inaccuracies of the supporting surface of the thrust bearing seat can be compensated by the flexible washer. This advantageously allows the thrust washer to be formed from a very hard and inflexible material. This advantageously increases the service life of the liquid pump.

In a preferred embodiment of the liquid pump, the thrust washer consists of ceramic or of carbide. Advantageously, both ceramic and carbide have very great hardnesses, whereby a thrust washer formed from these materials is subject to only very little wear.

It is expedient that the thrust washer is formed as a rubber mat. Advantageously, a flexible washer formed as a rubber mat has favorable elastic properties and makes it possible to compensate for production tolerances in the region of the thrust bearing seat of the pump housing of the liquid pump.

In one embodiment of the liquid pump, the pump housing has in the region of the thrust bearing seat a rivet pin, which fixes the flexible washer and the thrust washer in the axial direction. This advantageously represents a low-cost and easy-to-implement possible way of fixing the flexible washer and the thrust washer in the region of the thrust washer seat of the pump housing.

It is expedient that the rivet pin has been thermally re-shaped in such a way that the rivet pin engages around at least a portion of the flexible washer and the thrust washer. Advantageously, the thermal re-shaping of the rivet pin may be performed, for example, by hot stamping or by ultrasonic welding during the assembly of the liquid pump.

In a development of the liquid pump, the thrust washer has a clearance on its outer circumference. The rivet pin engages in this clearance and fixes the thrust washer against rotation about its axis. Advantageously, the thrust washer then cannot be made to rotate about its axis by rotation of the bearing mounted on the bearing bolt. It is likewise advantageous that, in this embodiment, the rivet pin simultaneously fixes the thrust washer in the axial direction and against rotation, whereby a simple and space-saving design is obtained.

In an additional development of the liquid pump, the pump housing has in the region of the thrust bearing seat three rivet pins, which fix the flexible washer and the thrust washer in the axial direction. Advantageously, very reliable fixing of the thrust washer is ensured by the provision of three rivet pins.

In an alternative embodiment of the liquid pump, the thrust washer has an axial aperture, wherein a projection is arranged in the axial aperture. In this case, the bearing bolt extends through the aperture of the thrust washer. The bearing bolt also has on its lateral surface a flattened portion, which is in engagement with the projection in the axial aperture. Advantageously, in this embodiment the thrust washer is fixed by the bearing bolt simultaneously in the axial direction and against rotation about the axis of the thrust washer. In this embodiment, the structural design of the liquid pump is advantageously additionally simplified as a result.

It is expedient that the projection is formed as a segment of a circle. Advantageously, the thrust washer can then be easily arranged on the bearing bolt.

In an additional development of the liquid pump, the axial aperture has a first portion and a second portion. The first portion and the second portion are in this case arranged one behind the other in the axial direction. The projection is in this case only formed in the second portion of the axial aperture. Advantageously, this prevents a step at the transition between a flattened portion of the bearing bolt and a non-flattened portion of the bearing bolt being present in the region of a bearing sliding surface between the thrust washer and the bearing mounted on the bearing bolt.

BRIEF DESCRIPTION OF THE DRAWINGS

The invention is now explained in more detail on the basis of the appended figures, in which.

DETAILED DESCRIPTION

Figure 1:
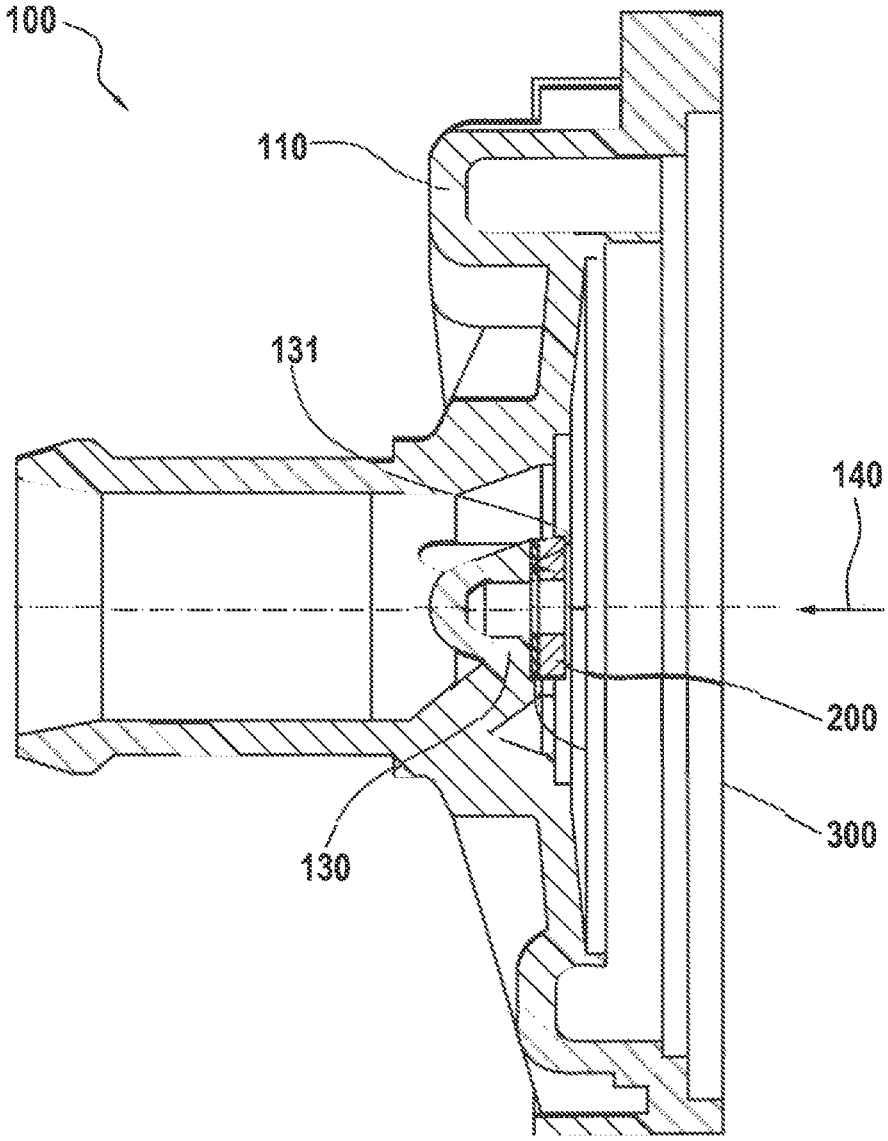
FIG. 1 shows a section through a pump housing of a water pump according to a first embodiment.

FIG. 1 shows a section through part of a pump housing 110 of a liquid pump 100. The liquid pump 100 may, for example, be intended for pumping water. The liquid pump 100 may, for example, serve as an additional water pump in a motor vehicle. As an additional water pump, the liquid pump 100 may serve for cooling charge air, a battery, a control device or other components of the motor vehicle.

The pump housing 110 has a thrust bearing seat 130, which is intended for receiving a bearing bolt that is not represented in FIG. 1. The bearing bolt then extends in an axial direction 140 into the thrust bearing seat 130. Mounted on the bearing bolt is a bearing, for example a bearing bush, which rotates about the bearing bolt during the operation of the liquid pump 100.

The thrust bearing seat 130 has a supporting surface 131, which is oriented in the direction of the rotating bearing. In order to avoid wear of the supporting surface 131 of the thrust bearing seat 130, a first thrust washer 200 is arranged between the supporting surface 131 and the bearing that is not represented in FIG. 1. There is also arranged between the supporting surface 131 of the thrust bearing seat 130 and the first thrust bearing 200 a first rubber mat 300, which serves the purpose of compensating for production-induced tolerances in the angularity of the supporting surface 131 of the thrust bearing seat 130 of the pump housing 110.

Figure 2:
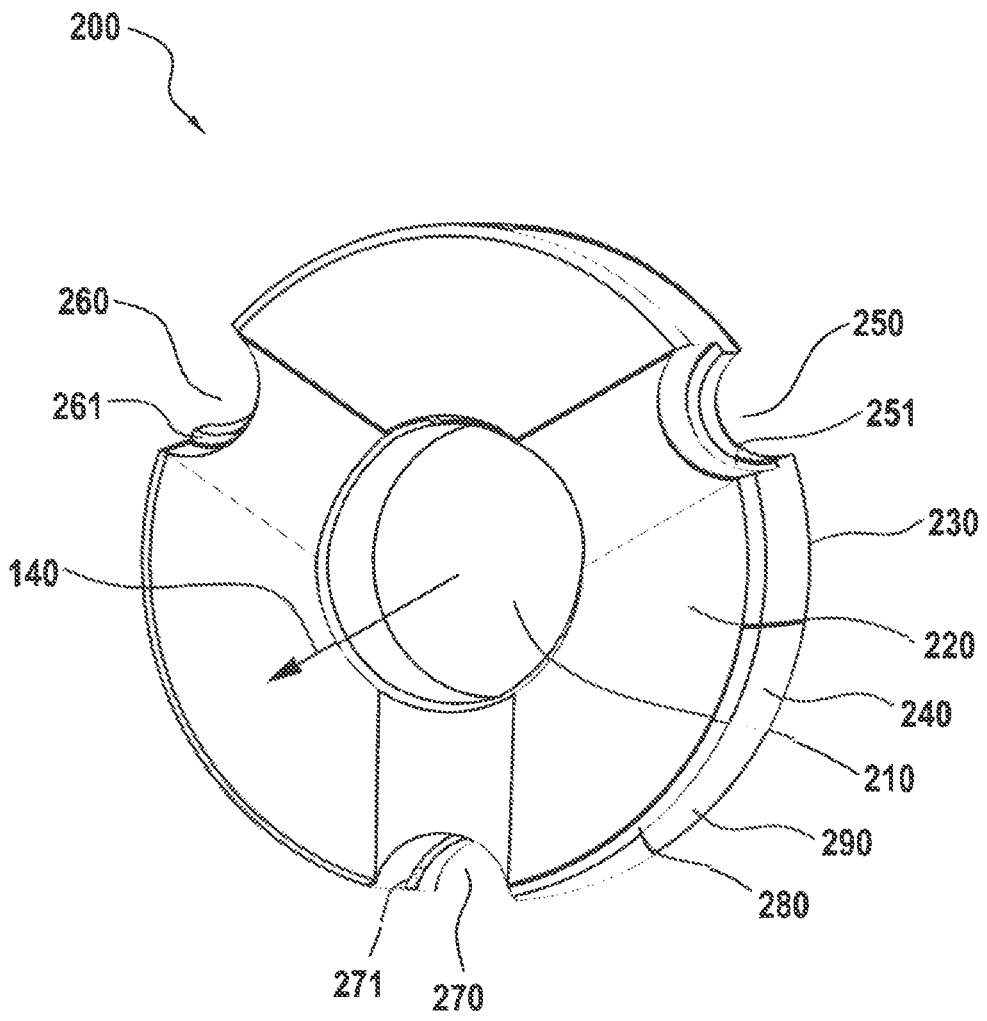
FIG. 2 shows a thrust washer according to the first embodiment.

FIG. 2 shows a perspective representation of the first thrust washer 200. The first thrust washer 200 is formed substantially as an annular disk or as a short hollow cylinder. Consequently, the first thrust washer 200 has an approximately annular first outer surface 220 and a second outer surface 230, opposite from the first outer surface 220. An outer circumference of the first thrust washer 200 is formed by a lateral surface 240. Centered around the axis of the first thrust washer 200, the first thrust washer 200 has an axial aperture 210.

The first thrust washer 200 preferably consists of a material that is harder than high-grade steel. The first thrust washer 200 may, for example, consist of a ceramic or of carbide.

On its outer circumference, that is to say in the region of the lateral surface 240, the first thrust washer 200 has a first clearance 250, a second clearance 260 and a third clearance 270. The clearances 250, 260, 270 are distributed uniformly around the lateral surface 240 and are consequently offset from one another in each case by 120°. Each of the clearances 250, 260, 270 is formed approximately as an arc of a circle.

In the axial direction 140, the first thrust washer 200 is divided into a first portion 280 and a second portion 290. The first portion 280 and the second portion 290 may in this case be formed in one piece and from one and the same material. The first portion 280 has the first outer surface 220 of the first thrust washer 200. The second portion 290 has the second outer surface 230 of the first thrust washer 200. In the region of the first portion 280, the clearances 250, 260, 270 of the first thrust washer 200 have a somewhat greater diameter than in the region of the second portion 290 of the first thrust washer 200. As a result, in the region of the first clearance 250 there is a first step 251 at the transition between the first portion 280 and the second portion 290. In the region of the second clearance 260 there is correspondingly a second step 261. In the region of the third clearance 270 there is a third step 271.

Figure 3:
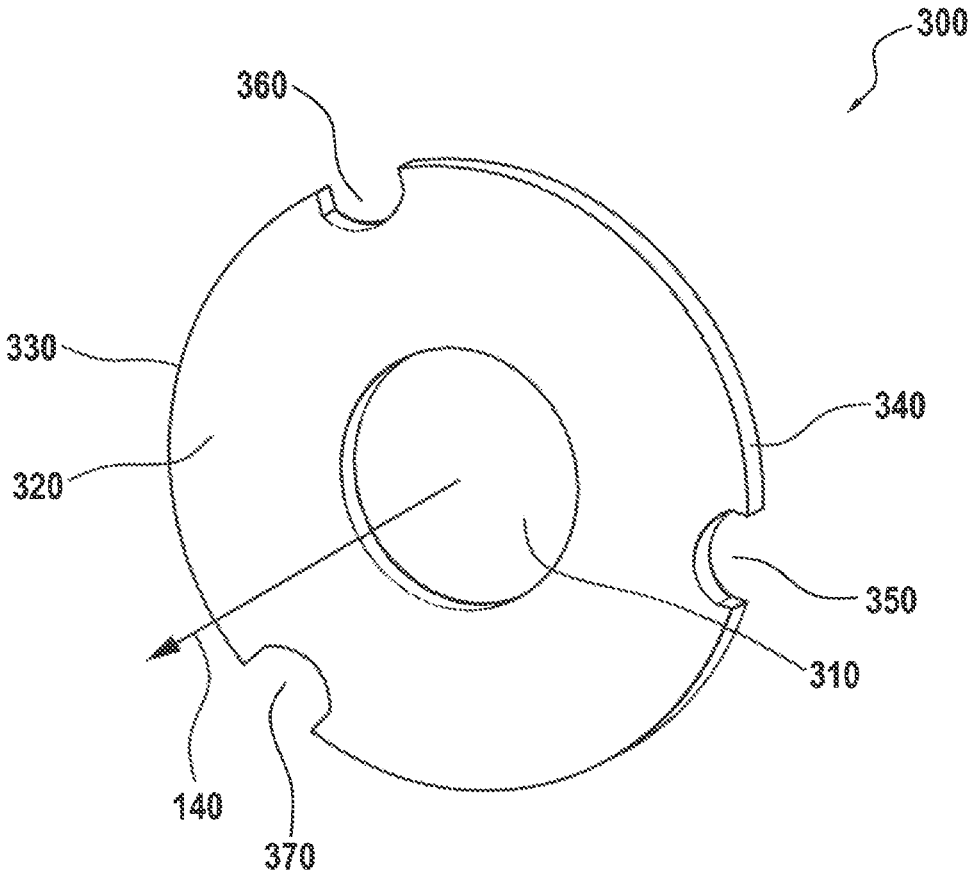
FIG. 3 shows a flexible washer according to the first embodiment.

FIG. 3 shows a perspective representation of the first rubber mat 300. The first rubber mat 300 is likewise formed substantially as an annular disk. The first rubber mat 300 may also be regarded as a very short hollow cylinder. The first rubber mat 300 consists of a flexible material, for example of rubber. The first rubber mat 300 may, however, also consist of some other flexible material and is therefore also referred to generally as a flexible washer. The first rubber mat 300 has an annular first outer surface 320 and a second outer surface 330, opposite from the first outer surface. An outer circumference of the first rubber mat 300 is formed by a lateral surface 340. Centered around its longitudinal axis, the first rubber mat 300 has an axial aperture. The diameter of the axial aperture 310 corresponds substantially to the diameter of the axial aperture 210 of the first thrust washer 200. The outside diameter of the first rubber mat 300 corresponds substantially to the outside diameter of the first thrust washer 200.

In the region of its lateral surface 340, the first rubber mat 300 has a first clearance 350, a second clearance 360 and a third clearance 370. The clearances 350, 360, 370 may have the form of cutouts of a circle. The clearances 350, 360, 370 may, however, also be differently formed. The clearances 350, 360, 370 are distributed uniformly around the outer circumference of the first rubber mat 300 and are consequently spaced apart from one another by in each case 120°.

Figure 4:
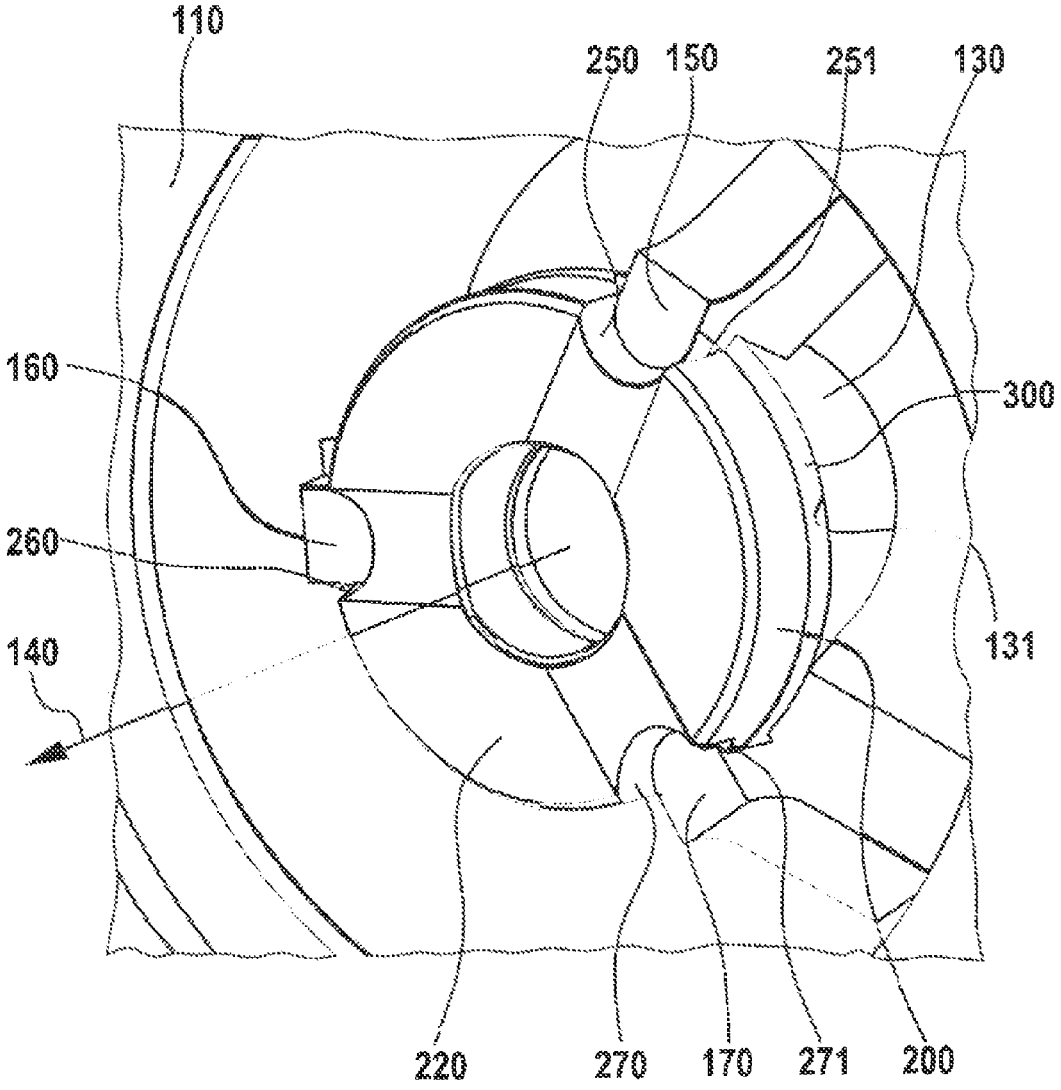
FIG. 4 shows an enlarged view of a thrust bearing seat of the water pump according to the first embodiment.

FIG. 4 shows an enlarged perspective view of part of the pump housing 110 of the liquid pump 100 in the region of the thrust bearing seat 130. The first rubber mat 300 is arranged on the supporting surface 131 of the thrust bearing seat 130 in such a way that the second outer surface 330 of the first rubber mat 300 is in contact with the supporting surface 131 of the thrust bearing seat 130. The first thrust washer 200 is arranged on the first rubber mat 300 in such a way that the second outer surface 230 of the first thrust washer 200 is in contact with the first outer surface 320 of the first rubber mat 300. The clearances 250, 260, 270 are aligned with the clearances 350, 360, 370 of the first rubber mat 300.

The thrust bearing seat 130 of the pump housing 110 of the liquid pump 100 has a first rivet pin 150, a second rivet pin 160 and a third rivet pin 170. The rivet pins 150, 160, 170 are in each case firmly connected to the thrust bearing seat 130. The first rivet pin 150 engages in the first clearance 350 of the first rubber mat 300 and the first clearance 250 of the first thrust washer 200 and thereby engages over the first step 251 of the first clearance 250 of the first thrust washer 200. The second rivet pin 160 correspondingly engages in the second clearance 360 of the first rubber mat 300 and the second clearance 260 of the first thrust washer 200 and engages around the second step 261 of the second clearance 260 of the first thrust washer 200. The third rivet pin 170 engages in the third clearance 270, 370 of the first rubber mat 300 and of the first thrust washer 200 and engages around the third step 271. Consequently, the first thrust washer 200 and the first rubber mat 300 are fixed by the rivet pins 150, 160, 170 in the axial direction 140 on the supporting surface 131 of the thrust bearing seat 130. Furthermore, the first rubber mat 300 and the first thrust washer 200 are fixed by the rivet pins 150, 160, 170 against rotation about the longitudinal axis of the first thrust washer 200.

The axial fixing of the first thrust washer 200 by the rivet pins 150, 160, 170, that is to say the engaging over of the steps 251, 261, 271 by the rivet pins 150, 160, 170, may take place, for example, by a thermal re-shaping of the three rivet pins 150, 160, 170. The thermal re-shaping of the rivet pins 150, 160, 170 may take place, for example, by hot stamping or by ultrasonic welding.

The configuration of the first thrust washer 200 with the first portion 280 and the second portion 290 and the resultant steps 251, 261, 271 in the clearances 250, 260, 270 has the advantage that the rivet pins 150, 160, 170 do not protrude beyond the first outer surface 220 of the first thrust washer 200.

Fewer than three rivet pins 150, 160, 170 or a greater number of rivet pins 150, 160, 170 could also be provided. The number of clearances 250, 260, 270, 350, 360, 370 of the first thrust washer 200 and of the first rubber mat 300 should then be correspondingly adapted.

Figure 5:
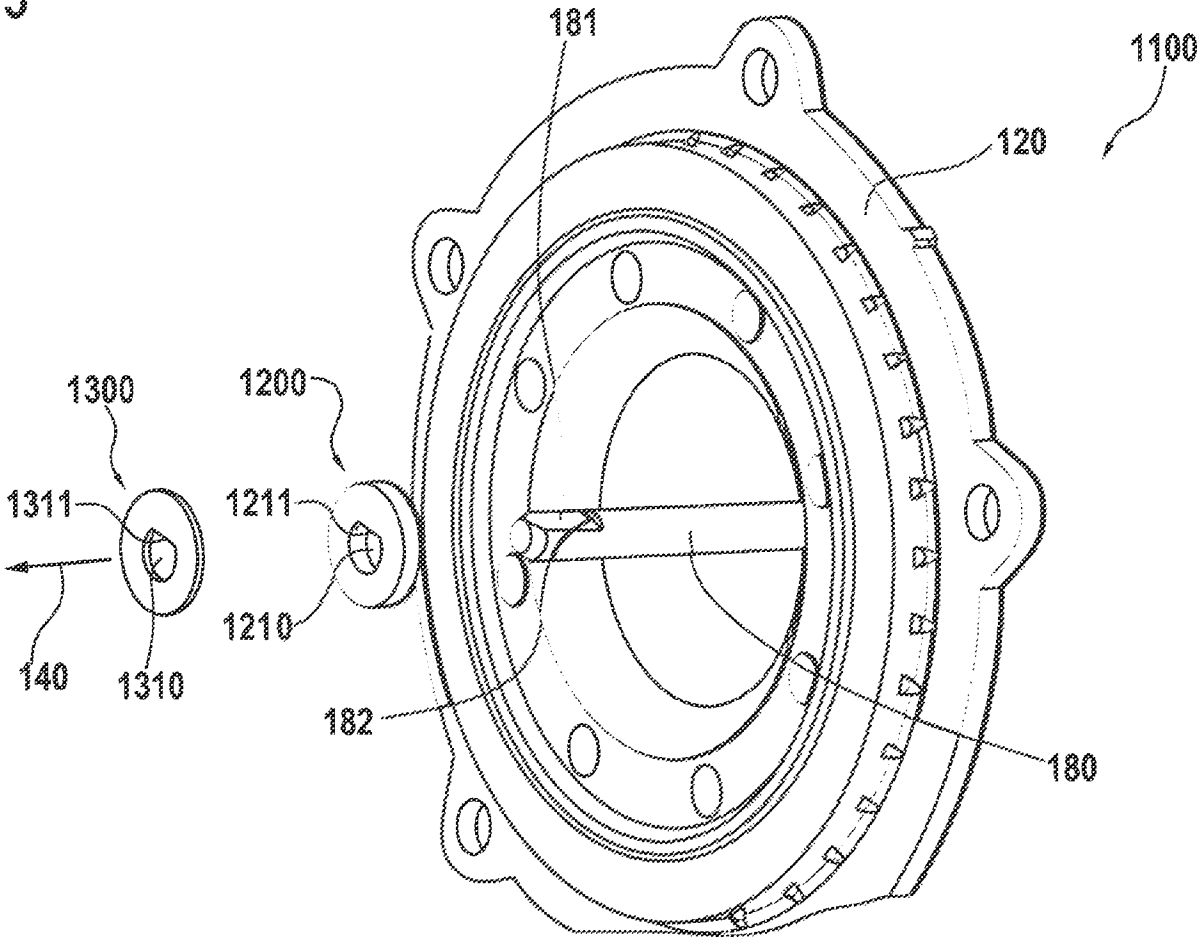
FIG. 5 shows part of a water pump according to a second embodiment.

FIG. 5 shows a perspective representation of part of a liquid pump 1100 according to a second embodiment. Components of the liquid pump 1100 of the second embodiment that correspond to those of the liquid pump 100 according to the first embodiment are provided with the same reference numerals. FIG. 5 shows a rear housing part 120 of the liquid pump 1100. The rear housing part 120 is intended for being connected to the pump housing 110, as can be seen in the sectional representation of FIG. 6 still to be explained below.

Arranged in the rear housing part 120 is a bearing bolt 180. The bearing bolt has an approximately circular-cylindrical basic form. At a free end, the bearing bolt 180 has a flattened portion 181. In the region of the flattened portion 181, a cross section of the bearing bolt 180 is not of an annular form but has the form of a circular disk from which a segment of a circle has been removed. At the transition between the flattened portion 181 of the bearing bolt 180 and the non-flattened portion of the bearing bolt 180 there is formed a step 182.

FIG. 5 also shows a perspective representation of a second thrust washer 1200 according to a second embodiment. The second thrust washer 1200 has a substantially hollow-cylindrical basic form with an axial aperture 1210. A lateral surface on the outer circumference of the second thrust washer 1200 is continuously formed and has no clearances. The axial aperture 1210 is substantially cylindrically formed. However, arranged in the axial aperture 1210 is a projection 1211, which has a cross section in the form of a segment of a circle. The size of the projection 1211 in this case corresponds substantially to the size of the missing material of the bearing bolt 180 in the region of the flattened portion 181 of the bearing bolt 180.

The second thrust washer 1200 once again preferably consists of a material that has a greater hardness than high-grade steel. The second thrust washer 1200 may, for example, consist of a ceramic or of carbide.

FIG. 5 further shows a perspective representation of a second rubber mat 1300 according to the second embodiment. The second rubber mat 1300 once again consists of a flexible material, for example of rubber. The second rubber mat 1300 is formed as a very short hollow cylinder and has an axial aperture 1310, the size of which corresponds to the size of the axial aperture 1210 of the second thrust washer 1200. Arranged in the axial aperture 1310 of the second rubber mat 1300 is a projection 1311, the form and dimensioning of which correspond to those of the projection 1211 of the second thrust washer 1200. The outer circumference of the second rubber mat 1300 is circularly formed and has no clearances.

Figure 6:
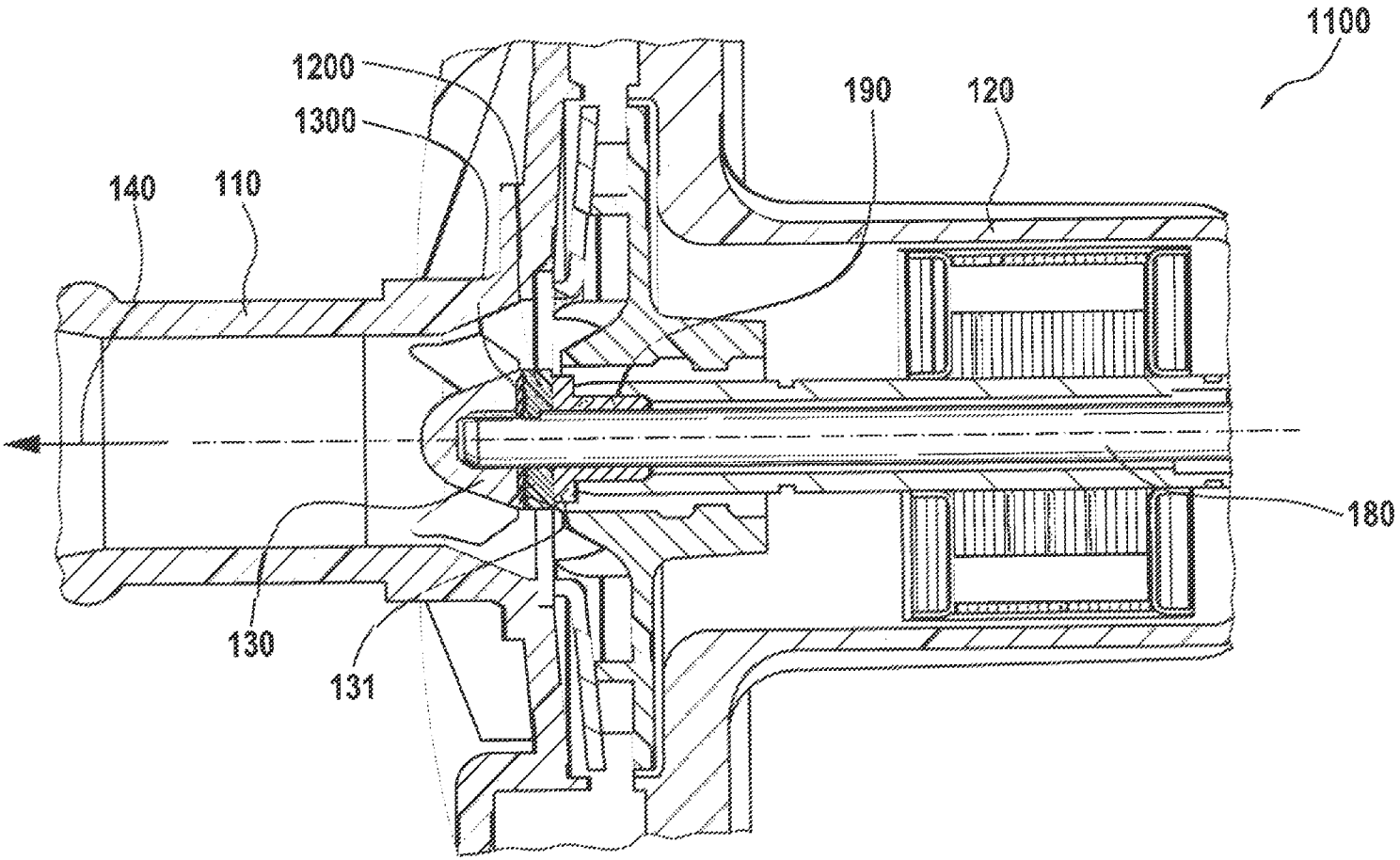
FIG. 6 shows a section through a pump housing of the water pump according to the second embodiment.

FIG. 6 shows a section through the liquid pump 1100 of the second embodiment. Represented are the pump housing 110 and the rear housing part 120 that is connected to the pump housing 110. The bearing bolt 180 extends in the axial direction 140 from the rear housing part 120 into the thrust bearing seat 130 of the pump housing 110.

Arranged on the supporting surface 131 of the thrust bearing seat 130 is the second rubber mat 1300. The second thrust washer 1200 is arranged on the second rubber mat 1300. The second rubber mat 1300 is therefore located between the second thrust washer 1200 and the supporting surface 131 of the thrust bearing seat 130 and, as a result, can compensate for tolerance-induced angularity errors of the supporting surface 131 of the thrust bearing seat 130. A bearing 190 is mounted on the bearing bolt 180 and in direct contact with the second thrust washer 1200. The bearing 190, which may also be referred to as a bearing bush, rotates during operation of the liquid pump 1100 about the axis of rotation that is formed by the bearing bolt 180 and thereby rubs against the second thrust washer 1200. The second thrust washer 1200 consists of a sufficiently hard material to withstand this friction without any great wear. The bearing 190 may, for example, consist of graphite.

Figure 7:
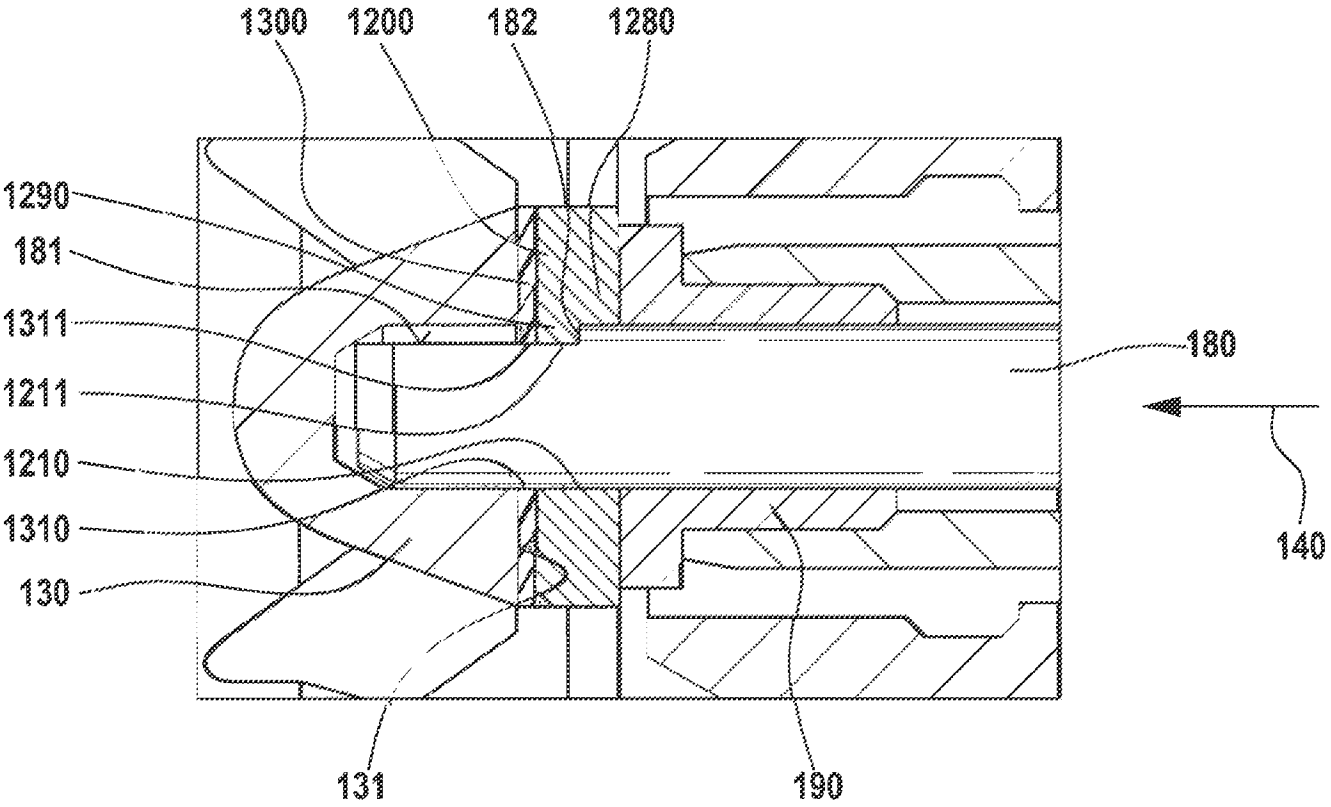
FIG. 7 shows an enlarged section through the pump housing of the water pump according to the second embodiment.

FIG. 7 shows, likewise in a sectional representation, an enlarged view of the region of the thrust bearing seat 130. It can be seen that the bearing bolt 180 extends through the bearing 190, through the axial aperture 1210 of the second thrust washer 1200 and through the axial aperture 1310 of the second rubber mat 1300. In this case, the projection 1211 in the axial aperture 1210 of the second thrust washer 1200 and the projection 1311 in the axial aperture 1310 of the second rubber mat 1300 are respectively in bearing contact with the flattened portion 181 of the bearing bolt 180. As a result, the second thrust washer 1200 and the second rubber mat 1300 are secured with respect to the bearing bolt 180 against rotation about the axis of rotation that is formed by the bearing bolt 180.

It can also be seen from FIG. 7 that the second thrust washer 1200 comprises in the axial direction 140 a first portion 1280 and a second portion 1290. The first portion 1280 of the second thrust washer 1200 is adjacent the bearing 190. The second portion 1290 of the second thrust washer 1200 is adjacent the supporting surface 131 of the thrust bearing seat 130.

The projection 1211 in the axial aperture 1210 of the second thrust washer 1200 is only formed in the second portion 1290 of the second thrust washer 1200. In the first portion 1280, the axial aperture 1210 is formed as a circular cylinder. This has the consequence that an edge formed on the projection 1211 of the second thrust washer 1200 at the transition between the second portion 1290 and the first portion 1280 comes to bear against the step 182 of the bearing bolt 180. The step 182 at the transition between the flattened region 181 and the non-flattened portions of the bearing bolt 180 is therefore arranged inside the axial aperture 1210 of the second thrust washer 1200. This advantageously has the effect that the second thrust washer 1200 (and consequently also the second rubber mat 1300) are fixed in the axial direction 140 on the supporting surface 131 of the thrust bearing seat 130 by the bearing bolt 180. It is also advantageously ensured that the step 182 is not arranged in the region of the sliding surface between the second thrust washer 1200 and the bearing 190.

What is claimed is:

1. A liquid pump (100, 1100), comprising a pump housing (110), which has a thrust bearing seat (130), a bearing bolt (180) and a bearing (190) mounted on the bearing bolt (180), wherein a thrust washer (200, 1200) is arranged between the thrust bearing seat (130) of the pump housing (110) and the bearing (190), wherein a flexible washer (300, 1300) is arranged between the thrust bearing seat (130) and the thrust washer (200, 1200), wherein the pump housing (110) has in a region of the thrust bearing seat (130) a rivet pin (150), and wherein the rivet pin (150) fixes the flexible washer (300) and the thrust washer (200) in an axial direction (140).

2. The liquid pump (100, 1100) according to claim 1, wherein the thrust washer (200, 1200) consists of ceramic or of carbide.

3. The liquid pump (100, 1100) according to claim 2, wherein the flexible washer (300, 1300) is formed as a rubber mat.

4. The liquid pump (100) according to claim 3, wherein the rivet pin (150) is thermally re-shaped in such a way that the rivet pin (150) extends over at least a portion of the flexible washer (300) and the thrust washer (200).

5. The liquid pump (100) according to claim 4, wherein the thrust washer (200) has an outer circumference and a clearance (250) on the outer circumference (240), and wherein the rivet pin (150) engages in the clearance (250) and fixes the thrust washer (200) against rotation about an axis of the thrust washer.

6. The liquid pump (100) according lo claim 5, wherein the pump housing (110) has in the region of the thrust bearing seat (130) three rivet pins (150, 160, 170), which fix the flexible washer (300) and the thrust washer (200) in the axial direction (140).

7. The liquid pump (100, 1100) according to claim 1, wherein the flexible washer (300, 1300) is formed as a rubber mat.

8. The liquid pump (100) according to claim 1, wherein the rivet pin (150) is thermally re-shaped in such a way that the rivet pin (150) extends over at least a portion of the flexible washer (300) and the thrust washer (200).

9. The liquid pump (100) according lo claim 1, wherein the thrust washer (200) has an outer circumference and a clearance (250) on the outer circumference (240), and wherein the rivet pin (150) engages in the clearance (250) and fixes the thrust washer (200) against rotation about an axis of the thrust washer.

10. The liquid pump (100) according to claim 1, wherein the pump housing (110) has in the region of the thrust bearing seat (130) three rivet pins (150, 160, 170), which fix the flexible washer (300) and the thrust washer (200) in the axial direction (140).

* * * * *